United States Patent [19]

Rapin et al.

[11] Patent Number: 5,006,683

[45] Date of Patent: Apr. 9, 1991

[54] DEVICE FOR THE ELECTRICAL INDUCTION HEATING OF A FLUID CONTAINED IN A PIPELINE

[75] Inventors: Jacques Rapin, Lyons; Philippe Vaillant, Cambrai, both of France

[73] Assignee: Framatome, Courbevoie, France

[21] Appl. No.: 491,430

[22] Filed: Mar. 9, 1990

[30] Foreign Application Priority Data

Mar. 10, 1989 [FR] France ..... 89 03188

[51] Int. Cl.[5] ..... H05B 6/10

[52] U.S. Cl. ..... 219/10.51; 219/10.65; 219/10.75; 219/10.79

[58] Field of Search ..... 219/10.51, 10.65, 10.79, 219/10.75, 10.491

[56] References Cited

U.S. PATENT DOCUMENTS

| | | | |
|---|---|---|---|
| 1,402,873 | 1/1922 | Ledwinka | 219/10.51 |
| 1,656,518 | 1/1928 | Hammers | 219/10.51 |
| 1,814,225 | 7/1931 | Neiss | 219/10.79 |
| 3,388,230 | 6/1968 | Cunningham et al. | 219/10.51 |
| 4,602,140 | 7/1986 | Sobolewski | 219/10.51 |
| 4,791,262 | 12/1988 | Ando et al. | 219/10.51 |

FOREIGN PATENT DOCUMENTS

| | | |
|---|---|---|
| 2568083 | 1/1986 | France . |
| 2128860 | 5/1984 | United Kingdom . |

*Primary Examiner*—Philip H. Leung

*Attorney, Agent, or Firm*—Pollock, Vande Sande & Priddy

[57] ABSTRACT

The device is a transformer comprising a magnetic circuit (22) in the form of a closed frame having four parallel columns (23, 24, 25*a*, 25*b*) and two primary windings (26*a*, 26*b*), each arranged around an inner column of the frame (22). The windings (26*a*, 26*b*) are connected at one end to a first phase (P1) and a third phase (P3) respectively and at their other end to a second phase (P2) of the three-phase current source (27). The pipeline (28) comprises a closed circuit consisting of three branched tubular arms (29*a*, 29*b*, 29*c*), each passing through a gap between two columns (23, 24, 25*a*, 25*b*) of the frame of the magnetic circuit, the inner columns (25*a*, 25*b*) being surrounded by an electrical windings (26*a*, 26*b*).

5 Claims, 2 Drawing Sheets

DEVICE FOR THE ELECTRICAL INDUCTION HEATING OF A FLUID CONTAINED IN A PIPELINE

FIELD OF THE INVENTION

The invention relates to a device for the electrical induction heating of a fluid contained in a pipeline having a closed-circuit part.

BACKGROUND OF THE INVENTION

When a fluid, especially a conductive fluid, such as a liquid metal, is treated, it may be necessary to carry out the heating or reheating of this liquid in a pipeline where the fluid circulates permanently or intermittently.

This purpose is served by using a transformer the primary part of which consists of at least one electrical winding arranged round an arm of a magnetic circuit and the secondary part of which consists of the closed circuit forming part of the pipeline containing the conductive fluid.

This closed circuit forming the short-circuit secondary part of the transformer has passing through it an electrical current generated by induction and circulating either in the wall of the pipeline or in the fluid or both in the pipeline and in the fluid, depending on whether the pipeline or the fluid or both at the same time are electrically conductive. The pipeline and/or the fluid are thus subjected to heating by the Joule effect.

It is necessary to ensure good magnetic coupling, thereby reducing the leakage fluxes, by careful choice of the form and relative location of the primary winding and secondary circuit.

The known prior art provided a heating device fed with single-phase current, consisting of a closed magnetic circuit having a central column, around which is arranged a primary winding fed with single-phase current, and two lateral columns substantially parallel to the central column.

The closed-circuit part of the pipeline consists of two arms connected at each of their ends to the pipeline and forming a loop surrounding the primary winding fed with single-phase current.

The disadvantage of this device of simple construction is that it has limited power for the following reasons:

- the hydraulic cross-section of the pipeline must be sufficiently high to ensure that the fluid flow necessary for dissipating the heating power can be established,
- on the other hand, this cross-section must be limited in view of requirements associated with the effective electric functioning of the device.

In fact, the magnetic leakage inductance assumes a magnitude which increases, in relation to the electrical resistance of the loop, with the cross-section of the pipeline.

Such a heating or reheating device fed with single-phase current is therefore of limited power, and this can be a considerable disadvantage in some uses.

As regards fast-neutron nuclear reactors using sodium as a heat-exchange fluid, the liquid sodium must be reheated in some parts of the installation, especially in the secondary circuit, in the vicinity of the steam generators. For example, it is necessary for the liquid sodium to be reheated in a pipeline which is branched off from the liquid sodium outlet pipeline from the steam generator, and on which is arranged a hydrogen detector which triggers an alarm when a water leak in one of the tubes of the steam generator results in the presence of hydrogen in the sodium at the outlet of the tubes of the steam generator. In fact, the detection of hydrogen carried out by separation of the hydrogen contained in the sodium makes it necessary to maintain the temperature of the sodium at a particular value ensuring that the detector functions satisfactorily.

It is likewise necessary to maintain the temperature of the liquid sodium near a specific value in some parts of the sodium circuit of the reactor, in order to prevent thermal shocks.

In this case, the fluid is a highly electrically conductive liquid metal and the heating power required can be of the order of approximately ten or a few tens of kW. It is then difficult, if not impossible, to obtain this heating power by feeding the transformer with single-phase current at the industrial frequency of the network.

It has therefore been proposed to use transformers fed with three-phase current, in order to prevent too unbalanced a load on the distribution network.

In this case, the magnetic circuit of the transformer consists of a frame comprising three substantially parallel columns, around each of which is arranged an electrical winding connected to one of the phases of the three-phase current source. The pipeline containing the conductive liquid, such as sodium where fast-neutron nuclear reactors are concerned, has three branched parts, each consisting of one or more turns of a tubular element receiving the liquid to be reheated. Each of the turns of the tubular element is arranged around a transformer winding fed with electrical current from one of the phases of the three-phase current source.

Such a device is of relatively complex construction in terms of the structure of the pipeline, and gives rise to difficulties as regards the heat insulation of this pipeline.

SUMMARY OF THE INVENTION

The object of the invention is, therefore, to provide a device for the electrical induction heating of a fluid contained in a pipeline having a closed-circuit part, the said device consisting of a transformer having at least two primary windings connected to a three-phase current source and a secondary part consisting of the closed circuit containing conductive fluid, this device being of very high efficiency at substantial heating power and having a simple structure, making it easily possible to provide the heat insulation of the pipeline in its closed-circuit part.

To this end, the transformer comprises a magnetic circuit in the form of a closed frame having four parallel columns and two primary windings, each arranged around an inner column of the frame and connected at one end to a first phase, and a third phase respectively, and at its other end to a second phase of the three-phase current source, the pipeline having a closed circuit consisting of three branched arms, each passing through a gap between two columns of the frame of the magnetic circuit.

BRIEF DESCRIPTION OF THE DRAWINGS

In order to make it easier to understand the invention, an embodiment of a reheating device according to the prior art fed with single-phase current, a reheating device according to the prior art fed with three-phase current and a heating device according to the invention fed with three-phase current will now be described by way of example with reference to the accompanying figures.

DESCRIPTION OF PREFERRED EMBODIMENT

Figure 1:
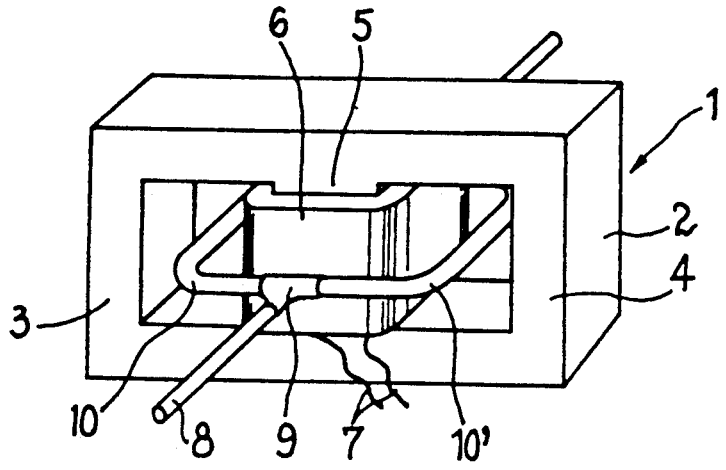
FIG. 1 is a perspective view of a device according to the prior art fed with single-phase current.

FIG. 1 shows a reheating device 1, consisting of a magnetic circuit 2 in the form of a frame of rectangular cross-section having two lateral columns 3 and 4 and a central column 5 which are substantially parallel to one another. The magnetic circuit 2 also includes an electrical winding 6, the ends 7 of which are connected to a single-phase current source.

The pipeline 8 receiving the fluid to be reheated, for example liquid metal, has two arms 10 and 10', each passing between a column 3 (or 4) of the circuit 2 and the central column 5 surrounded by the winding 6. The two arms 10 and 10' connected to the pipeline 8 by means of T junctions, such as 9, form the two parts of a closed-circuit loop forming the secondary part of the transformer, of which the winding of the magnetic circuit 2 forms the primary part.

As explained above, such a device can prove totally inadequate, especially for reheating a liquid metal requiring a considerable power.

Figure 2:
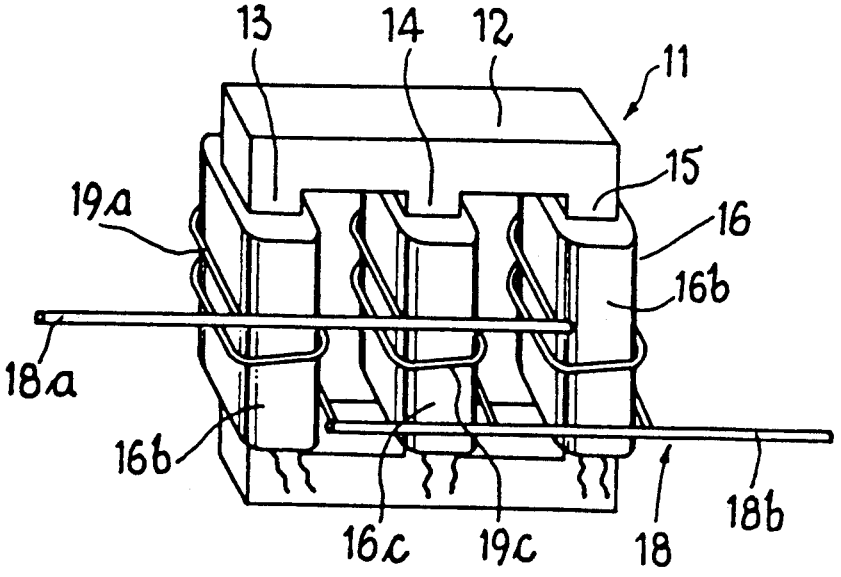
FIG. 2 is a perspective view of a device according to the prior art fed with three-phase current.

FIG. 2 illustrates a second device according to the prior art which uses a three-phase current source.

This device, designated as a whole by the reference 11, comprises a magnetic circuit 12 in the form of a frame of rectangular cross-section having three substantially parallel columns 13, 14 and 15. An electrical winding 16 is arranged round each of the columns 13, 14 and 15, each of its constituent windings 16*a*, 16*b* and 16*c* being fed from a different phase of a three-phase current source.

The pipeline 18 containing the fluid to be reheated, generally liquid metal, has an inlet part 18*a* receiving the fluid to be reheated and an outlet part 18*b* recovering the reheated fluid at the outlet of the device 11.

The pipeline also includes a closed-circuit part consisting of three tubular elements 19*a*, 19*b* and 19*c* in a branch connection between the inlet part 18*a* of the pipeline 18 and the outlet part 18*b* and each surrounding a winding (16*a*, 16*b* and 16*c*, respectively), at the same time forming two turns round the corresponding winding.

The branched elements 19*a*, 19*b* and 19*c* form the short-circuit secondary part of the reheating device.

As can be seen in FIG. 2, the closed-circuit part of the pipeline which is in three parts is somewhat complex. The construction of the device therefore requires relatively long and costly operations. Moreover, the heat insulation of the pipeline is very difficult to provide.

Figure 3:
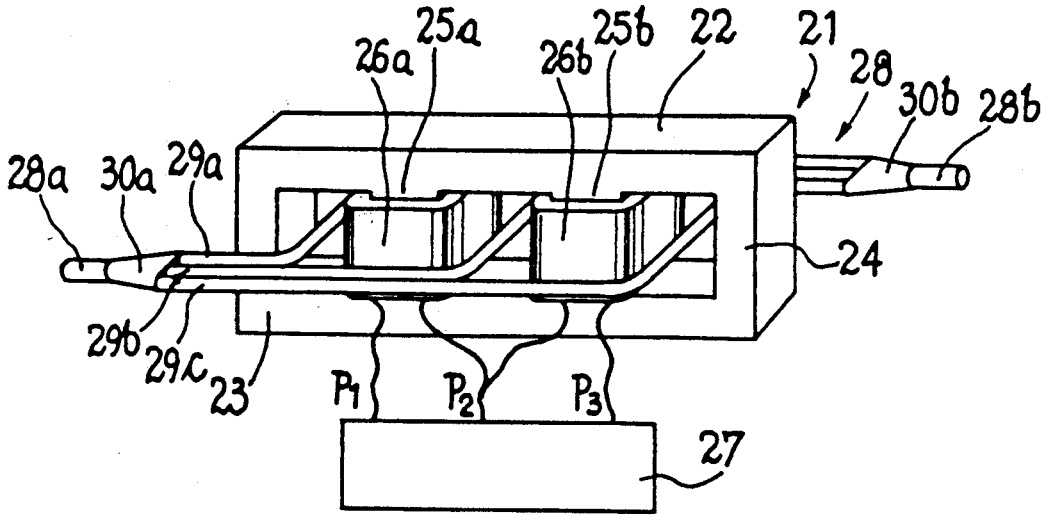
FIG. 3 is a perspective view of a device according to the invention fed with three-phase current.

FIG. 3 illustrates a reheating device 21 according to the invention, consisting of a magnetic circuit 22 of rectangular cross-section comprising four substantially parallel columns 23, 24, 25*a*, 25*b*, namely, two columns 23 and 24 closing the outer frame and two central columns 25*a* and 25*b*. A primary winding 26*a* and 26*b* is arranged around each of the central columns 25*a* and 25*b* respectively.

The windings 26*a* and 26*b* are connected to a three-phase current source 27 ensuring that they are fed with electrical current. The coupling of the windings 26*a* and 26*b* is obtained by means of an open-triangular arrangement, one of the ends of the winding 26*a* being connected to the phase P1 of the source 27, the other end of the winding 26*a* being connected to the phase P2. While the first end of the winding 26*b* is connected to the phase P2 and the second end of the winding 26*b* is connected to the phase P3.

This ensures a balanced feed of the primary windings 26*a* and 26*b*.

The pipeline 28 receiving the fluid to be reheated has an inlet part 28*a* receiving the fluid to be reheated and an outlet part 28*b* recovering the reheated fluid at the outlet of the device 21.

The closed-circuit part of the pipeline 28 consists of three tubular arms 29*a*, 29*b* and 29*c* branchconnected at their end to the inlet part 28*a* and to the outlet part 28*b* of the pipeline 28 by means of junctions 30*a* and 30*b*, respectively.

The three branched tubular arms 29*a*, 29*b* and 29*c* form the closed-circuit part of the pipeline 28.

Each of the arms 29*a*, 29*b* and 29*c* passes through an aperture of the magnetic circuit 22 located between two successive columns of this magnetic circuit. At least one of the columns delimiting the passage apertures of the arms 29*a*, 29*b* and 29*c* is surrounded by one of the primary windings 26*a* and 26*b*.

The tubular arms 29*a*, 29*b* and 29*c* each contain two bends and have the general form of an S. They also have a substantially identical form and length.

These three arms constitute the short-circuit secondary part of the reheating device produced in the form of a transformer fed with three-phase current.

Figure 4:
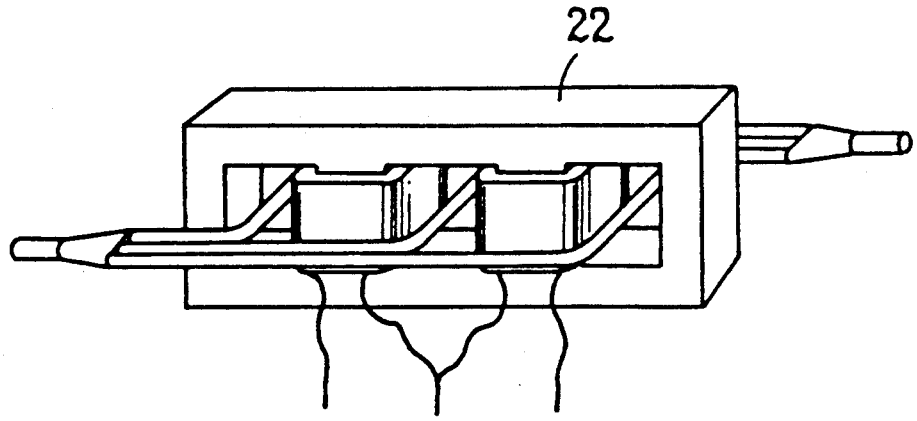
FIG. 4 is a perspective view similar to that of FIG. 3, showing the circulation of the currents and fluxes employed during reheating by the use of the device according to the invention.

As can be seen from FIG. 4, the three-phase current source supplies a current of intensity I1 at the phase P1, a current of intensity I2 at the phase P2 and a current of intensity I3 at the phase P3. A magnetic flux $\phi 1$ is generated in the magnetic circuit between the columns 23 and 25*a*, a magnetic flux of intensity $\phi 2$ between the columns 25*a* and 25*b* and a magnetic flux of intensity $\phi 3$ between the columns 25*b* and 24.

An electrical current is generated by induction in each of the arms 29*a*, 29*b* and 29*c*.

Since the resistance of the primary windings is low and a good coupling is obtained between the secondary part and the primary part as a result of the form of the arms of the secondary part, the electrical losses in the primary windings and the magnetic leakage can be ignored, for the purpose of calculating the electromotive force induced in each of the arms 29*a*, 29*b* and 29*c* and the induced currents. This electromotive force is substantially equal to each of the phase voltages of the three-phase network, divided by the number N of turns of each of the primary windings. It is assumed that the primary windings 26*a* and 26*b* have the same number N of turns.

The result of this is that the currents induced in the arms 29*a*, 29*b* and 29*c* are respectively equal to NI1, NI2, and NI3.

In the embodiment illustrated in FIGS. 3 and 4, the three arms, 29*a*, 29*b* and 29*c* have substantially identical developed lengths and cross-sections. Their electrical resistances are therefore equal. Moreover, since the passage cross-section is the same for the three arms 29*a*, 29*b* and 29*c*, the total flow of fluid in the pipeline 28 is distributed in a substantially balanced manner among the three arms 29*a*, 29*b* and 29*c*. The form of these arms makes it possible to obtain excellent magnetic coupling between the primary winding and the secondary circuit.

If the magnetizing current is ignored, the intensity absorbed on each of the line wires connected to a phase of the network is substantially equal to the intensity passing through each of the arms 29*a*, 29*b* and 29*c* of the pipeline, divided by the number N of turns of each of the primary windings.

The currents NI1, NI2, and NI3 circulate either in the fluid contained in the corresponding arm, if the fluid is a conductive fluid, or in the tubular arm, if this is produced from conductive material, or both in the tubular arm and in the fluid, if both are electrically conductive. These currents NI1, NI2 and NI3 generate a release of heat as a result of the Joule effect, allowing the heating or reheating of the fluid filling the pipeline 28. This fluid circulates in the pipeline continuously or intermittently.

The form of the secondary part of the reheating device is especially simple, and each of the arms 29*a*, 29*b* and 29*c* of this secondary part passes once and once only through each of the apertures of the magnetic circuit located between two successive columns. Moreover, the S-form of each of the arms, although very simple, allows excellent coupling between the primary part and the secondary part of the reheating device.

The heat insulation of the pipeline 28 in its closed-circuit part can be obtained without difficulty, inasmuch as the arms are of simple form and are not wound in the form of turns round the primary windings.

It has been determined that, for an equal heating power and with a fluid to be reheated of identical type, the device according to the invention offers the fluid a considerably higher passage cross-section than in a pipeline with a reheating device fed with single-phase current, of the type described with reference to FIG. 1.

The arms forming the close-circuit part-of the pipeline and the secondary part of the transformer may have a form different from that described.

The cross-section of the pipeline containing the fluid to be reheated and the cross-section of the arms of the secondary part can be matched to the flow of the fluid to be reheated, taking into account the necessary heating power and the characteristics of the three-phase current source.

Finally, the heating device according to the invention can be used not only for reheating liquid metals, such as sodium forming the heat-exchange fluid of a fast-neutron-nuclear reactor, or such as aluminum which is poured in a casting installation, but also for the reheating of any liquid whether or not it is electrically conductive, used in a process requiring it to be reheated or its temperature maintained. In particular, the invention can have uses in the chemical industry.

We claim:

1. Device for the electrical induction heating of a fluid contained in a pipeline (28) having a closed-circuit (29*a*, 29*b*, 29*c*), said device consisting of a transformer (21) having two primary windings (26*a*, 26*b*) connected to a three-phase current source (27) and a secondary part consisting of the closed circuit (29*a*, 29*b*, 29*c*) of said pipeline containing the fluid, wherein said transformer (21) comprises a magnetic circuit (22) in the form of a closed frame having four parallel columns (23, 24, 25*a*, 25*b*), each of said primary windings being arranged around a different one of said columns of said frame (22) and being connected at a first end thereof to a first phase (P1) and a third phase (P3), respectively, and at a second end thereof to a second phase (P2) of said three-phase current source (27), said closed circuit of said pipeline consisting of three branched tubular arms (29*a*, 29*b*, 29*c*), each passing through a gap between two of said columns (23, 24, 25*a*, 25*b*) of said frame (22) of said magnetic circuit.

2. Device according to claim 1, wherein said three tubular arms (29*a*, 29*b*, 29*c*) of said pipeline (28) have substantially equal lengths and cross-sections.

3. Device according to claim 1, wherein each of said tubular arms (29*a*, 29*b*, 29*c*) passes only once through each gap located between two said columns (23, 24, 25*a*, 25*b*) of said magnetic circuit (22).

4. Device according to claim 1, wherein each of said tubular arms (29*a*, 29*b*, 29*c*) consists of a generally S-shaped tube having two bends.

5. Device according to claim 1, wherein said frame of said magnetic circuit (22) has a rectangular outer contour, two of said four columns (23, 24) corresponding to small closing sides of said frame (22), and the other two of said four columns forming two central columns (25*a*, 25*b*) interposed between two larger sides of said frame and being surrounded by said primary windings (26*a*, 26*b*).

* * * * *